US006865838B2

(12) United States Patent
Williams et al.

(10) Patent No.: US 6,865,838 B2
(45) Date of Patent: Mar. 15, 2005

(54) MULTIPLE AUTO PRIMER SYSTEM FOR MUZZLE-LOADING FIREARM

(76) Inventors: Dean N. Williams, 777 E. College St., Griffin, GA (US) 30224; Ned J. Hollenbach, Rt. 1, Tower Dr., Murfreesboro, AR (US) 71958

( * ) Notice: Subject to any disclaimer, the term of this patent is extended or adjusted under 35 U.S.C. 154(b) by 0 days.

(21) Appl. No.: 10/654,829

(22) Filed: Sep. 4, 2003

(65) Prior Publication Data

US 2004/0103574 A1 Jun. 3, 2004

Related U.S. Application Data

(60) Provisional application No. 60/408,127, filed on Sep. 4, 2002.

(51) Int. Cl.[7] ..... F41C 9/08
(52) U.S. Cl. ..... 42/51; 89/1.3; 89/27.13
(58) Field of Search ..... 42/51; 89/1.3, 89/27.13

(56) References Cited

U.S. PATENT DOCUMENTS

| | | | |
|---|---|---|---|
| 35,524 | A | 6/1862 | Jones |
| 40,432 | A | 10/1863 | Seely |
| 3,780,464 | A | 12/1973 | Anderson |
| 4,123,866 | A | 11/1978 | Wiethoff |
| 4,135,322 | A | 1/1979 | Tice et al. |
| 4,222,191 | A | 9/1980 | Lee et al. |
| 4,437,249 | A | 3/1984 | Brown et al. |
| 4,442,620 | A | 4/1984 | Drake et al. |
| 4,466,209 | A | 8/1984 | Strickland et al. |
| 4,601,125 | A | 7/1986 | Curtis |
| 4,669,211 | A | 6/1987 | Russell |
| 4,845,874 | A | 7/1989 | Etheridge et al. |
| 4,875,303 | A | 10/1989 | DeWeert et al. |
| 4,888,901 | A | 12/1989 | French et al. |
| 4,974,357 | A | 12/1990 | Jones et al. |

(List continued on next page.)

OTHER PUBLICATIONS

Harris, Tom, "How Machine Guns Work", howstuffworks.com, 1998–2003, pp. 1–15, HowStuffWorks, Inc. Sep. 2, 2003.

(List continued on next page.)

*Primary Examiner*—Stephen M. Johnson
(74) *Attorney, Agent, or Firm*—Gardner Groff, P.C.

(57) ABSTRACT

A method and apparatus for loading and ejecting ignition devices into a muzzle-loading firearm. A magazine contains a plurality of ignition devices, which are sequentially loaded from the magazine onto the breech plug of the firearm by a sliding bolt or other loading assembly. After firing, the loading assembly is actuated to extract and eject the spent ignition device and load a new ignition device onto the breech plug.

24 Claims, 2 Drawing Sheets

U.S. PATENT DOCUMENTS 5,080,017 A 1/1992 Asikainen
5,092,072 A 3/1992 Fritts
5,109,623 A 5/1992 French
5,448,939 A 9/1995 Findlay, Sr. et al.
5,467,551 A 11/1995 Kruse
5,487,232 A * 1/1996 Osborne et al. ..... 42/51
5,511,334 A 4/1996 Ball et al.
5,544,441 A 8/1996 Mahn et al.
5,544,563 A 8/1996 Richards et al.
5,596,167 A 1/1997 Davis
5,606,817 A 3/1997 Sachse
5,615,507 A 4/1997 French
5,623,779 A 4/1997 Rainey, III
5,651,203 A * 7/1997 Knight ..... 42/25
5,664,355 A 9/1997 Ronkainen
5,706,598 A 1/1998 Johnston
5,718,073 A 2/1998 Sachse et al.
5,726,378 A 3/1998 Barrett
5,737,863 A 4/1998 Rainey, III
5,755,052 A 5/1998 Keeney
5,787,629 A 8/1998 Campbell et al.
5,794,373 A 8/1998 Moon
5,806,227 A 9/1998 Yoder
5,813,158 A 9/1998 Campbell et al.
5,842,623 A 12/1998 Dippold
5,907,920 A 6/1999 Laney
5,918,401 A 7/1999 Rowlands
5,950,864 A 9/1999 Cash et al.
5,992,074 A 11/1999 Ruger et al.
6,085,630 A 7/2000 Manis
6,176,031 B1 1/2001 Ramsey
6,212,991 B1 4/2001 Frazier, III
6,233,860 B1 5/2001 Hazen
6,343,553 B1 2/2002 O'Dwyer
6,367,188 B1 4/2002 Vargas
6,370,806 B1 4/2002 Klebes et al.
6,385,887 B1 5/2002 Johnston
6,405,631 B1 6/2002 Milek
6,516,549 B1 2/2003 Hildebrandt et al.
6,672,476 B2 * 1/2004 Cash et al. ..... 221/311
2001/0013191 A1 8/2001 Cate
2001/0013192 A1 8/2001 Murello et al.
2002/0035800 A1 3/2002 Lewis
2002/0070229 A1 6/2002 Cash et al.

* cited by examiner

MULTIPLE AUTO PRIMER SYSTEM FOR MUZZLE-LOADING FIREARM

CROSS-REFERENCE TO RELATED APPLICATIONS

This application claims the benefit of U.S. Provisional Patent Application Ser. No. 60/408,127, filed Sep. 4, 2002, the content of which is hereby incorporated herein by reference in its entirety.

TECHNICAL FIELD

The present invention relates generally to the field of firearms and, more particularly, to an apparatus and method for loading and ejecting primers, percussion caps, and/or other ignition devices into and from a muzzle-loading firearm.

BACKGROUND OF THE INVENTION

In a typical muzzle-loading firearm (including without limitation, muzzle-loading rifles, muskets, shotguns, pistols, cannon, and the like), the main powder charge and the projectile are loaded into the muzzle of the firearm, and a powder ignition source (a "primer") is provided at the breech end of the barrel. Many such firearms utilize a percussion cap, a 0.209 shotgun primer, a musket cap, or another ignition device as the powder ignition source. The ignition device is typically installed by hand or with a tool onto a nipple of a breech plug with a flash hole that communicates a powder flash from the ignition device into the barrel of the firearm to detonate the main powder charge and propel the projectile toward the target. After firing, the ignition device is typically removed, again by hand or using a tool, and the firearm is reloaded.

This manual installation and removal of ignition devices can be difficult, especially when wearing gloves or when excited. In addition, manually installing and removing ignition devices, one at a time after each firing, is time consuming and may delay a second shot by several seconds or more. Various efforts have been made to speed up the loading process, but none has proven fully satisfactory in reducing the difficulty and delay that typically results from manual installation and removal of single ignition devices.

Accordingly, it can be seen that needs exist for improved methods and apparatus for installing and removing an ignition device for a muzzle-loading firearm. It is to the provision of an improved method and apparatus meeting these and other needs that the present invention is primarily directed.

SUMMARY OF THE INVENTION

The present invention provides improved methods and apparatus for installing and removing ignition devices for a muzzle-loading firearm. Briefly described, in one aspect, the present invention is an apparatus for carrying, loading, extracting, and/or ejecting one or more ignition devices in and from a muzzle-loading firearm. The apparatus comprises a magazine for containing at least one ignition device and a loading assembly for loading the ignition device from the magazine to a breech plug of the firearm for firing. Preferably, the apparatus further comprises an extractor for extracting and ejecting the spent ignition device after firing.

In another aspect, the present invention is a magazine for containing a plurality of ignition devices and sequentially dispensing the ignition devices for loading into the breech plug of a muzzle-loading firearm.

In another aspect, the present invention is a muzzle-loading firearm comprising a barrel having a muzzle end and a breech end, a breech plug in the breech end of the barrel, a magazine for containing a plurality of ignition devices, and a loading assembly for sequentially loading ignition devices from the magazine into the breech plug for firing. Preferably, the muzzle-loading firearm further comprises an extractor for extracting and ejecting the spent ignition device after firing.

In yet another aspect, the invention is a method for sequentially loading, extracting, and ejecting ignition devices in and from a muzzle-loading firearm. The method comprises loading a plurality of ignition devices into a magazine, loading the magazine into the muzzle-loading firearm, loading a first ignition device from the magazine into the breech plug of the firearm for firing, and extracting the first ignition device from the breech plug after firing.

Accordingly, the present invention permits users to load ignition devices onto the breech plug of a muzzle-loading firearm much more quickly and easily. In this way, the users can fire their muzzle-loading firearms much more quickly and easily, which makes hunting, target-shooting, and other activities much more enjoyable and productive.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWING FIGURES

DETAILED DESCRIPTION OF THE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
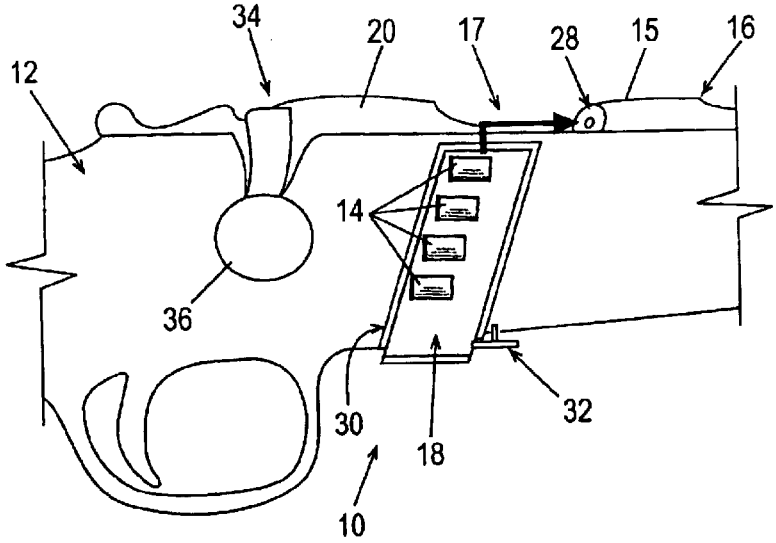
FIG. 1 is a side view, in partial cross-section, of a portion of a firearm showing a primer magazine and a loading assembly according to a first exemplary embodiment of the present invention.
Figure 2:
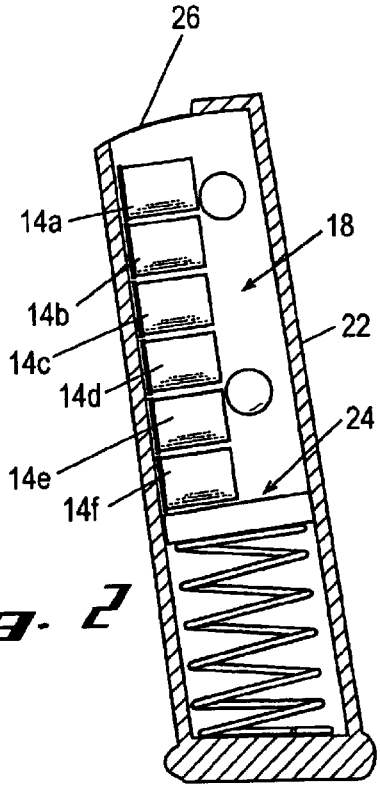
FIG. 2 is a side view, in cross-section, of the primer magazine of FIG. 1.
Figure 4:
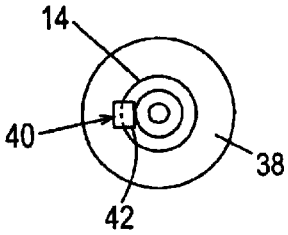
FIG. 4 is an end view of the loading assembly of FIG. 3.
Figure 3:
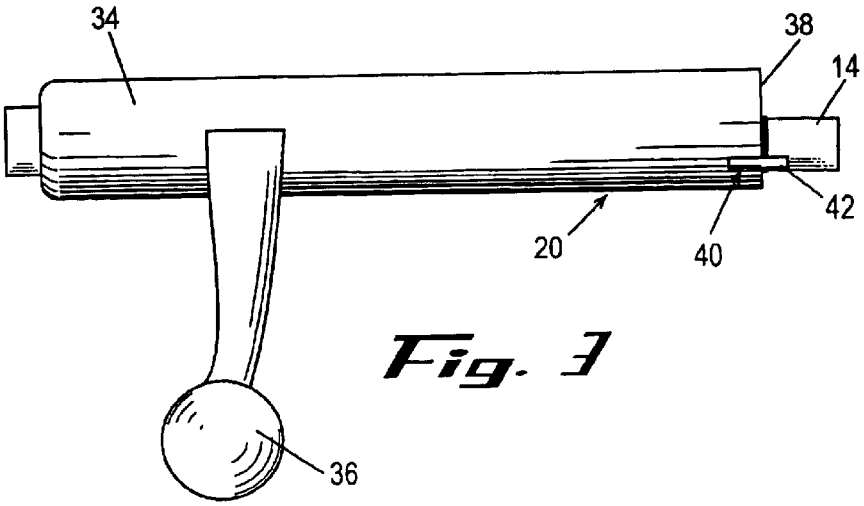
FIG. 3 is a side view of the loading assembly of FIG. 1.

FIGS. 1–3 show a multiple auto primer system 10 according to a first exemplary embodiment of the present invention. The system 10 is included on a firearm 12 for sequentially loading, extracting, and ejecting ignition devices 14 for igniting the main powder charge in the breech end 15 of the barrel 16 of the firearm 12. The ignition devices 14 can be, for example, percussion caps, musket caps, 0.209 shotshell primers, other types of ammunition primers, blank ammunition rounds, starter pistol rounds, electronic igniters, or any other type of ignition source or primer. Typically, the system 10 is included on a muzzle-loading rifle 12, but it can be readily adapted for use on other types of muzzle-loading firearms by persons of ordinary skill in the art.

The system 10 includes a magazine 18 and a loading assembly 20. Preferably, the magazine 18 is provided by a housing 22 for containing one or more, and preferably a plurality of the ignition devices 14. For example, the magazine 18 may comprise a removable elongated housing 22 having a spring-biased floor mechanism 24 and an dispensing end 26 with an opening and a retainer for holding the ignition devices 14 until they are dispensed. In other words, the magazine 18 in this form is generally similar in construction and operation to a typical spring-driven ammunition clip for a modern breech-loading firearm, but adapted for the size and shape of the ignition devices 14. In alternate embodiments, the magazine 18 comprises a rotating cylinder similar in form to that of a modern revolver, a tubular magazine similar in form to that of a modern shotgun, a belt similar in form to that of a modern automatic weapon, a strip, roll, or ring of interconnected primers similar in form to caps used in cap guns, or another type of magazine suitable for storing and sequentially dispensing the ignition devices 14 into the breech 17 of the muzzle-loading firearm 12.

The magazine 18 is received by a receiver portion 30 of the muzzle-loading firearm 12. Preferably, the receiver portion 30 is provided by a vertical opening through the stock of the firearm 12 that is sized and shaped to removably receive the magazine 18. In alternate embodiments, the receiver portion 30 may provided by a channel formed into the side of the firearm, a track or retaining tabs extending from the side of the firearm, a recess formed into the top of the firearm, or another structure that positions the magazine 18 for sequentially feeding the ignition devices 14 into the breech 17 of the firearm 12. It will be understood that in alternative embodiments having an integral magazine that is not removable from the firearm (e.g., the tubular magazine), the receiver portion is not necessarily provided.

In addition, a release mechanism 32 is preferably provided for releasably securing the magazine 18 in place. For example, the magazine release mechanism 32 may be provided by a swivel or pivotal member, a spring-loaded member, a snap-tight fit, or another mechanism for releasably securing the magazine 18 to the firearm 12 for use and then selectively permitting its removal.

Turning now to the loading assembly 20, it is operable for sequentially loading the ignition devices 14 from the magazine 18 to the breech plug 28. As used herein, "breech plug" means any component that engages the primer and communicates the primer flash to the main powder charge, including external nipples. In the depicted embodiment, the loading assembly 20 comprises a sliding bolt assembly including a sliding bolt 34 that can be slidably actuated to open and close the breech by a bolt-action handle 36. The bolt 34 has a head 38 that, when the bolt is in its forward closed position, engages the next ignition device 14*a* (see FIG. 2) from the magazine 18, which has been urged into the breech 17 by the spring-loaded floor 24, and advances it into or onto the breech plug 28.

In an example embodiment, the loading assembly includes a mechanism for setting the firing mechanism for firing (cocking the firing pin and/or arming the trigger) as the bolt is opened and closed. For safety reasons, in other example embodiments the loading assembly only serves to load and discharge the primers and the firing mechanism is set by an additional action. In other alternative sliding bolt embodiments, the loading assembly has a bolt that can be slidably actuated by a lever-action, a pump-action, a recoil-driven autoloading action, a gas-driven autoloading action, or another type of actuation mechanism. And in alternative embodiments where the magazine moves to dispense the next ignition device, it may be desirable to include a trigger-operated mechanism for automatically advancing the magazine immediately after the firearm is fired. For example, the loading assembly may include a trigger-operated mechanism for rotating the rotating cylinder magazine in the breech, a trigger-operated mechanism (e.g., a cam-driven pawl-and-lever mechanism) for feeding the belt magazine or the strip, roll, or ring of interconnected primers into the breech, or another type of mechanism for sequentially dispensing the ignition devices 14 to the breech of the muzzle-loading firearm 12.

In addition, an extractor 40 is provided to grip and position the ignition devices 14 on the breech plug 28 for firing when the sliding bolt is moved forward to its closed position, and for extracting and ejecting the spent ignition devices from the firearm 12 after firing when the sliding bolt is moved backward to its open position. Preferably, the extractor 40 comprises an arm extending forward from the bolt head 38 and having a lip 42 that engages a rim on the base of the ignition device 14 for removing it from the breech plug 28 when the bolt is opened. In addition, the extractor arm is preferably spring-loaded for pushing on the base of the extracted spent ignition devices 14 to eject them from the firearm 12. The extractor 40 in this form is generally similar in construction to a typical extractor/ejector for spent cartridges in conventional breech-loading firearms. In alternative embodiments, the extractor 40 is mounted in place adjacent the breech plug, includes a separate spring-loaded ejector, includes a pivotal spring-loaded member, or is otherwise configured for extracting and ejecting the spent ignition devices.

In the method of use of the depicted embodiment, the user loads one or more of the ignition devices 14 into the magazine 18 and installs the magazine into the receiver portion 30 of the muzzle-loading firearm 12. The user also loads the main powder charge and projectile into the barrel 16 of the muzzle-loading firearm 12 from the muzzle end, in typical fashion. Then the user actuates the loading assembly 20, as by retracting and advancing the sliding bolt 34, to engage and load the first ignition device 14*a* (see FIG. 2), which has been urged from the magazine 18 into the breech 17, onto the breech plug 28 of the muzzle-loading firearm 12. The firing mechanism is set for firing and the safety mechanism, if provided, is released before firing. The muzzle-loading firearm 12 is then aimed at a target and fired, for example by actuating a trigger mechanism in typical fashion. After firing, the user actuates the loading assembly 20, as by retracting the sliding bolt 34, to extract and eject the spent first ignition device 14*a*.

If desired, a second shot can be quickly and easily made by again loading a main powder charge and projectile into the muzzle end of the firearm barrel 16, advancing the loading assembly 20 to engage and load the second ignition device 14*b* from the magazine 18 onto the breech plug 28, and firing the firearm 12. In this way, the user does not need to manually load another ignition device into the firearm 12, but only to actuate the loading assembly 20 to advance the previously loaded ignition device 14*b* from the magazine 18 onto the breech plug 28. And if the user wants to take additional shots, he or she can repeat this part of the process for subsequent ignition devices 14*c*, 14*d*, 14*e*, and 14*f*, as may be desired in a given situation.

Figure 5:
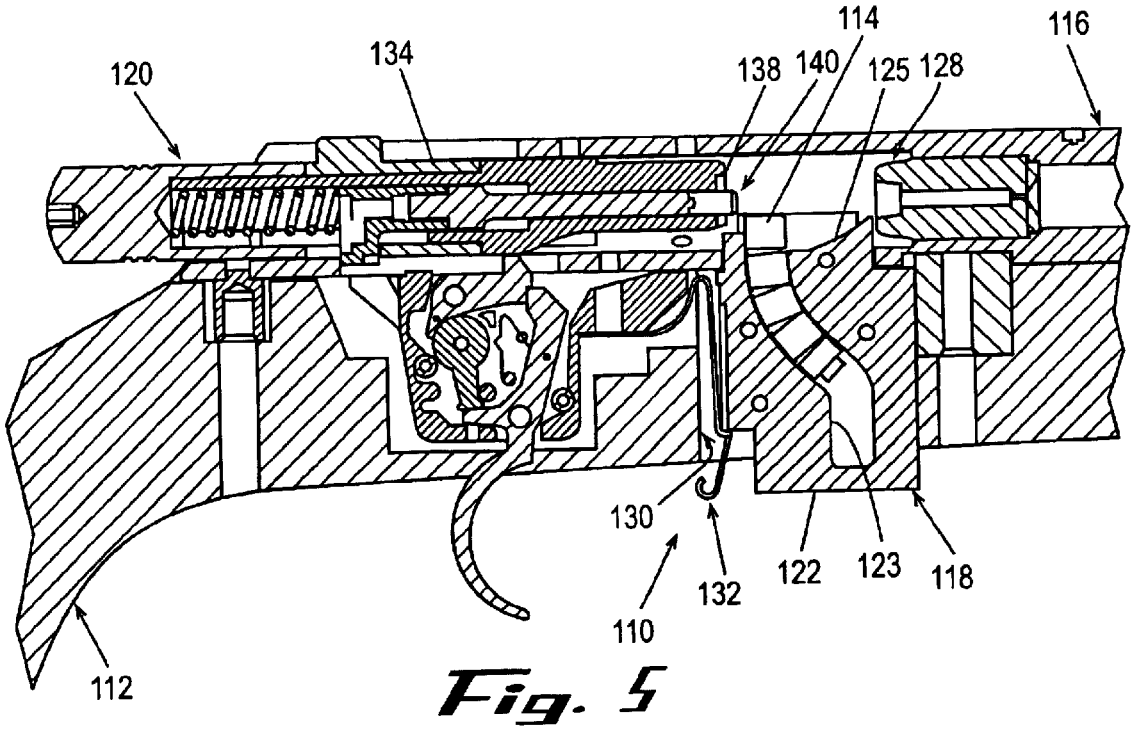
FIG. 5 is a side view, in cross-section, of a portion of a firearm showing a primer magazine and a loading assembly according to a second exemplary embodiment of the present invention, with the loading assembly in the disengaged (bolt open) position.
Figure 6:
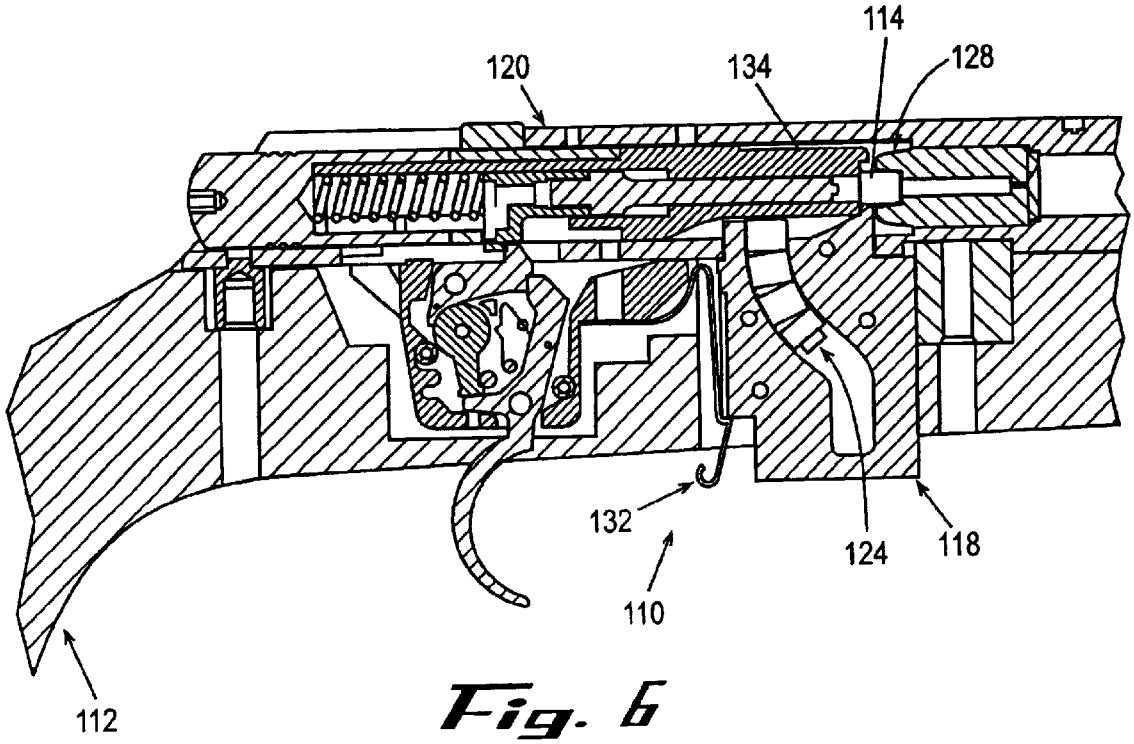
FIG. 6 is a side view, in cross-section, of the firearm, the primer magazine, and the loading assembly of FIG. 5, with the loading assembly in the engaged (bolt closed) position.

Referring now to FIGS. 5 and 6, there is shown a multiple auto primer system 110 for a muzzle-loading firearm according to a second exemplary embodiment of the present invention. Similar to the first exemplary embodiment, the system 110 includes a magazine 118 for ignition devices 114 and a loading assembly 120. The loading assembly 120 loads the ignition devices from the magazine 118 to the breech plug 128 in the barrel 116 of the muzzle-loading firearm 112 when the sliding bolt 134 is cocked to the forward position of FIG. 6. And the extractor 140 engages and extracts the spent ignition devices 114 from the breech plug 128 when the sliding bolt 134 is cocked to the rear position of FIG. 5.

In this embodiment, the magazine 118 has a housing 122 with a curved channel 123 formed in it for storing the ignition devices 114, and a spring-loaded floor 124 for urging the ignition devices into the breech. The curved channel 123 accommodates the abutting rims of adjacent ignition devices 114 so that they fit more tightly and are more stable in the magazine 118. In addition, this embodiment has a magazine release mechanism 132 provided by a leaf spring-type clip for releasably securing the magazine 118 in place. Furthermore, this embodiment has a guide ramp 125 for guiding the ignition devices 114 onto the nipple of the breech plug 128 as they are engaged and pushed forward by the bolt head 138.

Accordingly, it can be seen that the present invention enables a user to pre-load a number of ignition devices into a muzzle-loading firearm, quickly and easily advance the ignition devices for firing, and quickly and easily extract and eject the spent ignition devices after firing, even when wearing gloves or when excited. In this way, a hunter may be able to get off a second shot before the prey has gotten out of sight and range. And for target-shooting and other shooting activities, the faster speed and greater ease of using the firearm makes shooting more enjoyable and productive.

While the invention has been disclosed in preferred forms for illustration purposes, those skilled in the art will readily recognize that many modifications, additions, and deletions can be made therein without departing from the spirit and scope of the invention as set forth in the following claims.

What is claimed is:

1. An apparatus for carrying and loading one or more ignition devices into a muzzle-loading firearm having a breech plug, comprising:

a magazine for containing at least one of the ignition devices, wherein the magazine has a curved channel formed therein for receiving the ignition devices; and a loading assembly for loading the ignition device from the magazine into engagement with the breech plug of the firearm for firing.

2. The apparatus of claim 1, further comprising an extractor for extracting the spent ignition device from the breech plug of the firearm after firing.

3. The apparatus of claim 2, wherein the extractor is configured for ejecting spent ignition devices from the firearm.

4. The apparatus of claim 2, wherein the loading assembly comprises a sliding bolt, and wherein the extractor is operated when the bolt is slid from a forward position to a rear position.

5. The apparatus of claim 1, wherein the loading assembly comprises a sliding bolt.

6. The apparatus of claim 5, further comprising a guide ramp for guiding the ignition device into engagement with the breech plug when the bolt is slid from a rear position to a forward position.

7. An apparatus for carrying and loading one or more ignition devices into a muzzle-loading firearm having a breech plug, comprising:

a magazine for containing at least one of the ignition devices; and a loading assembly for loading the ignition device from the magazine into engagement with the breech plug of the firearm for firing;

wherein the firearm has a receiver portion formed therein and the magazine is releasably received in the receiver portion.

8. The apparatus of claim 7, further comprising an extractor for extracting the spent ignition device from the breech plug of the firearm after firing.

9. The apparatus of claim 8, wherein the extractor is configured for ejecting spent ignition devices from the firearm.

10. The apparatus of claim 8, wherein the loading assembly comprises a sliding bolt, and wherein the extractor is operated when the bolt is slid from a forward position to a rear position.

11. The apparatus of claim 7, wherein the loading assembly comprises a sliding bolt.

12. The apparatus of claim 11, further comprising a guide ramp for guiding the ignition device into engagement with the breech plug when the bolt is slid from a rear position to a forward position.

13. A magazine for use with a muzzle-loading firearm having a breech, a breech plug, and a loading assembly, the magazine comprising:

a housing for containing a plurality of ignition devices and sequentially dispensing the ignition devices into the breech for loading into engagement with the breech plug by operation of the loading assembly, wherein the housing has a curved channel formed therein for receiving the ignition devices.

14. The magazine of claim 13, further comprising a plurality of ignition devices loaded therein.

15. The magazine of claim 14, wherein the plurality of ignition devices are selected from percussion caps, musket caps, 0.209 shotshell primers, and blank ammunition.

16. A magazine for use with a muzzle-loading firearm having a breech, a breech plug, and a loading assembly, the magazine comprising:

a housing for containing a plurality of ignition devices and sequentially dispensing the ignition devices into the breech for loading into engagement with the breech plug by operation of the loading assembly, wherein the magazine is releasably received in a receiver portion of the firearm.

17. The magazine of claim 16, further comprising a plurality of ignition devices loaded therein.

18. The magazine of claim 17, wherein the plurality of ignition devices are selected from percussion caps, musket caps, 0.209 shotshell primers, and blank ammunition.

19. In a muzzle-loading firearm having a barrel with a breech end and having a breech plug in the breech end of the barrel, the improvement comprising:

a magazine for containing a plurality of ignition devices;

a loading assembly for sequentially loading the ignition devices from the magazine into engagement with the breech plug of the muzzle-loading firearm for firing; and a receiver portion defined in the firearm for removably receiving the magazine.

20. The improvement of claim 19, wherein the improvement further comprises an extractor for coupled to the firearm for extracting and ejecting the ignition devices after firing.

21. A muzzle-loading firearm, comprising:

a barrel having a breech end;

a breech plug in the breech end of the barrel;

a magazine for containing a plurality of ignition devices;

a loading assembly for sequentially loading ignition devices from the magazine to the breech plug of the firearm; and a receiver portion defined in the firearm for removably receiving the magazine.

22. A method for sequentially loading a plurality of ignition devices into a muzzle-loading firearm, the method comprising:

loading the ignition devices into a magazine;

loading the magazine into the muzzle-loading firearm; and loading a first one of the ignition devices from the magazine to the breech plug of the firearm for firing; and extracting a spent first ignition device from the breech plug of the firearm after firing.

23. The method of claim 22, further comprising ejecting the extracted first ignition device from the firearm.

24. The method of claim 23, further comprising loading a subsequent one of the ignition devices from the magazine to the breech plug of the firearm.

* * * * *